US005816942A

United States Patent [19]

Hayashi et al.

[11] Patent Number: 5,816,942

[45] Date of Patent: Oct. 6, 1998

[54] WOUND GOLF BALL

[75] Inventors: Junji Hayashi; Hisashi Yamagishi, both of Chichibu, Japan

[73] Assignee: Bridgestone Sports Co., Ltd., Tokyo, Japan

[21] Appl. No.: 831,523

[22] Filed: Apr. 1, 1997

[30] Foreign Application Priority Data

Apr. 3, 1996 [JP] Japan ..... 8-106314

[51] Int. Cl.[6] ..... A63B 37/06; A63B 37/12

[52] U.S. Cl. ..... 473/359; 473/363; 473/365; 473/377

[58] Field of Search ..... 473/363, 351, 473/378, 359, 365, 377

[56] References Cited

U.S. PATENT DOCUMENTS 5,542,663 8/1996 Kato et al. ..... 473/363

5,674,137 10/1997 Maruko et al. ..... 473/378 X 5,704,853 1/1998 Maruko et al. ..... 473/351

*Primary Examiner*—George J. Marlo

*Attorney, Agent, or Firm*—Sughrue, Mion, Zinn, Macpeak & Seas, PLLC

[57] ABSTRACT

A wound golf ball comprising: a center ball, thread rubber wound thereon, and a cover, wherein the center ball consists of a center core having an outer diameter of up to 37 mm and a distortion of 1 to 5 mm under a constant load of 100 kg and an enclosure layer enclosing the center core and having a Shore D hardness of up to 54. The center ball has an outer diameter of 33 to 38 mm, and the center core comprises a rubber composition having a base rubber, a co-cross linking agent and a peroxide and being free of an oily substance.

13 Claims, 1 Drawing Sheet

WOUND GOLF BALL

BACKGROUND OF THE INVENTION

1. Field of the Invention

This invention relates to a wound golf ball which is improved in spin, control, flight, and feel.

2. Prior Art

As compared with two- and multi-piece solid golf balls having a solid core enclosed with one or more covers, wound golf balls are superior in hitting feel and controllability, but inferior in flight distance upon driver shots because of an increased spin rate.

In order to increase the flight distance of wound golf balls upon driver shots, attempts were made to suppress a spin rate as disclosed in JP-A 129072/1984 and 4104/1994. One exemplary wound golf ball has a center ball with a relatively large diameter.

The wound golf balls having a large diameter center ball are intended to increase the flight distance upon driver shots by suppressing the spin rate. Since the center ball is relatively large, the hardness of the center ball has substantial influence on ball performance. The hitting feel becomes hard or soft depending on whether the center ball is hard or soft. In either case, a pleasant hitting feel is not obtainable because of the lack of click. In addition, a satisfactory flight distance is not always obtainable since restitution is somewhat lost.

"Click" is the sensation imparted to the golfer together with sound when the ball is hit by a golf club. Too strong a click means poor hitting feel whereas the golfer sensing no click gets no reliable hitting feel. Pleasant hitting feel has to be accompanied by appropriate click.

The wound golf balls proposed in the prior art can achieve an increase of flight distance by suppressing spin susceptibility, but at the sacrifice of some of the benefits inherent to wound golf balls. They do not fully meet the demand of many golf players. It is thus desired to solve these problems.

SUMMARY OF THE INVENTION

An object of the invention is to provide a wound golf ball which is improved in spin, control, flight distance, and hitting feel.

Regarding a wound golf ball comprising a center ball having thread rubber wound thereon and a cover enclosing the wound center ball, the inventors have found that by constructing a relatively large diameter center ball of the two-layer structure consisting of a center core and an enclosure layer and selecting the hardness of the center core and the enclosing layer so as to optimize the hardness distribution of the center ball, the ball is improved in control and flight performance and given a soft pleasant hitting feel with appropriate click.

According to the invention, a relatively hard center core is formed so as to undergo a distortion of 1 to 5 mm under a constant load of 100 kg and to an outer diameter of up to 37 mm. A relatively soft enclosure layer is formed so as to have a Shore D hardness of up to 54. A center ball consisting of the center core and the enclosure layer is adjusted to a relatively large outer diameter of 33 to 38 mm. Then the relatively hard center core contributes to appropriate click while the relatively soft enclosure layer contributes to a soft hitting feel. The relatively large diameter center ball consisting of the center core and the enclosure layer is effective for suppressing a spin rate, achieving an increase of flight distance. These functions and results are effectively achieved in good balance by setting the hardness and diameter of the center core, the hardness of the enclosure layer, and the diameter of the center ball as defined above.

Therefore, the present invention provides a wound golf ball comprising a center ball, thread rubber wound thereon, and a cover. The center ball consists of a center core having an outer diameter of up to 37 mm and a distortion of 1 to 5 mm under a constant load of 100 kg and a layer enclosing the center core and having a Shore D hardness of up to 54. The center ball has an outer diameter of 33 to 38 mm.

BRIEF DESCRIPTION OF THE DRAWING

These and further features of the present invention will be apparent with reference to the following description and drawings.

The sole FIGURE.

DETAILED DESCRIPTION OF THE INVENTION

Figure 1:
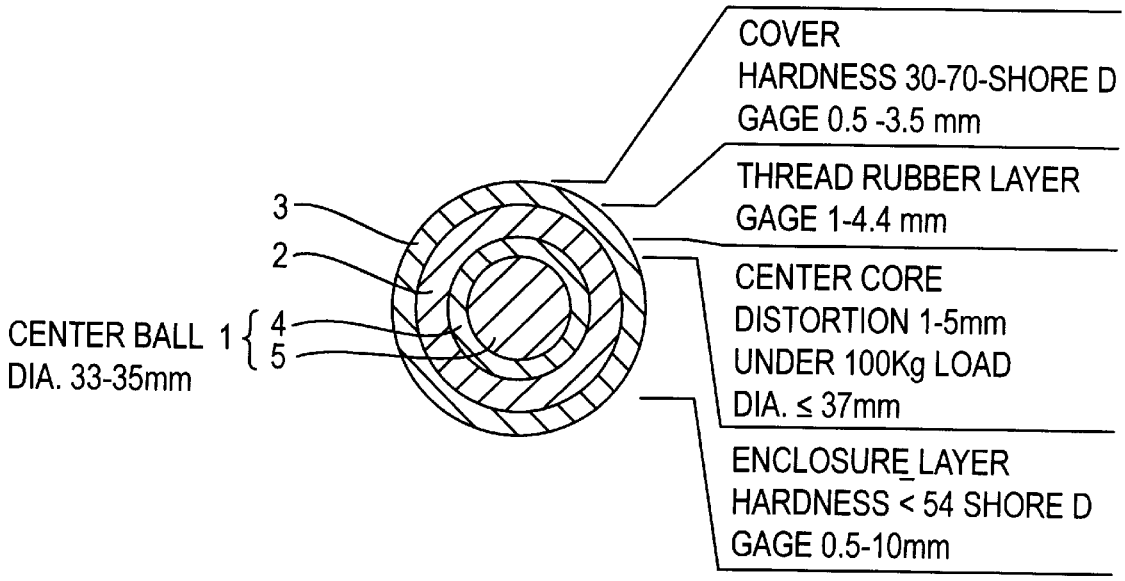
FIG. 1 is a schematic cross-sectional view of a wound golf ball according to one embodiment of the invention.

The wound golf ball of the invention is shown in FIG. 1 comprising a center ball 1, a thread rubber layer 2 formed by winding thread rubber around the center ball 1, and a cover 3 encasing the thread rubber layer 2. According to the invention, the center ball 1 is of a two-layer structure consisting essentially of a center core 4 and an enclosure layer 5 surrounding the core 4.

The center core 4 of the center ball 1 is formed relatively hard so as to undergo a distortion of 1 to 5 mm, preferably 1.8 to 4.8 mm under a constant load of 100 kg so that the ball may give a hitting feel with click. The center core 4 should have an outer diameter of up to 37 mm, preferably 20 to 36 mm. If a center core undergoes a distortion of more than 5 mm under a load of 100 kg, hitting feel becomes too soft to produce click. A center core with a distortion of less than 1 mm is too hard and gives a hard hitting feel. A center core with a diameter of more than 37 mm gives a hard hitting feel and naturally requires the thread rubber layer 2 to be thinner, adversely affecting restitution. Click would be lost with a center core having a diameter of less than 20 mm.

The center core may be formed by conventional methods, for example, by heat compression molding of a well-known rubber composition comprising base rubber, a co-crosslinking agent, and a peroxide.

More particularly, the baser rubber may be polybutadiene rubber or a mixture of polybutadiene rubber and polyisoprene rubber as used in conventional solid centers. Use of 1,4-polybutadiene rubber containing more than 90% of cis-structure is recommended to provide high restitution. The co-crosslinking agents used herein include zinc and magnesium salts of unsaturated fatty acids such as methacrylic acid and acrylic acid and esters such as trimethylpropane trimethacrylate as in the prior art. Zinc acrylate is preferably used because high restitution is expectable. The amount of co-crosslinking agent blended is preferably 15 to 60 parts by weight per 100 parts by weight of the base rubber. Various peroxides may be used although dicumyl peroxide and a mixture of dicumyl peroxide and 1,1-bis(t-butylperoxy)-3,3,5-trimethylcyclohexane are preferred. The amount of peroxide blended is preferably 0.5 to 1.5 parts by weight per 100 parts by weight of the base rubber.

If desired, zinc oxide or barium sulfate may be blended in the rubber composition for adjusting the specific gravity.

Blending of other additives such as anti-oxidants is acceptable. Since a center core is generally frozen in order to prevent the center core from deforming upon winding of thread rubber, an oily substance is often added to the center core for facilitating freezing. The oily substance added, however, can reduce restitution and adversely affect the temperature dependency of restitution. In the practice of the invention, it is thus recommended to omit such an oily substance.

The center ball 1 of the wound golf ball according to the invention is constructed by surrounding the center core 4 with the enclosure layer 5.

The enclosure layer 5 is formed on the spherical surface of the center core having a relatively high hardness and serves to maintain the click given by the center core and provide the golf ball with a soft hitting feel. It is a relatively soft layer having a Shore D hardness of up to 54, preferably 33 to 53. If the enclosure layer has a Shore D hardness of more than 54, the center ball as a whole is too hard to impart a soft hitting feel. The gage of the enclosure layer 5 is generally 0.5 to 10 mm, especially 0.5 to 7 mm although it may be appropriately selected in accordance with the hardness of the enclosure layer itself and the outer diameter of the center core 4. An enclosure layer having a gage of more than 10 mm naturally requires the center core to be reduced in diameter, with a possibility of losing click. An enclosure layer having a gage of less than 0.5 mm would not exert its own function of avoiding a hard hitting feel.

The enclosure layer 5 may be formed by injection molding a well-known thermoplastic elastomer around the center core 4. Any thermoplastic elastomer may be used insofar as it cures into a layer having a hardness in the above-defined range. Use may be made of polyester thermoplastic elastomers, polyamide thermoplastic elastomers, and ionomer resins. For example, there are available ionomer resins such as Hytrel 4047, 4767 and 8122 (Toray-duPont K.K.), Surlyn (E. I. duPont), and Himilan (Mitsui-duPont Polychemical K.K.) and polyamide thermoplastic elastomers such as Pebax (Toray K.K.). Particularly when the cover is formed by heat compression molding, to be described later, the heat can cause the enclosure layer to melt to lose resilience. It is then recommended for the enclosure layer to use a resin having a higher melting point than the heating temperature.

The center ball 1 having the center core 4 enclosed with the enclosure layer 5 should have an outer diameter of 33 to 38 mm, preferably 34 to 37 mm in order to appropriately reduce a spin rate to increase flight distance. A center ball having an outer diameter of more than 38 mm naturally requires the resilient thread rubber layer 2 to be thin, inviting a reduction of flight distance. A center ball having an outer diameter of less than 33 mm is ineffective for reducing a spin rate, failing to prevent sharp rise and flight shortage.

Next, the cover 3 of the wound golf ball according to the present invention may be produced using a well-known cover stock, for example, a resin composition comprising a base such as ionomer resins, polyurethane elastomers and balata rubber and conventional amounts of additives including pigments such as titanium white and dispersants such as magnesium stearate.

Although the hardness of the cover 3 is not particularly limited, it preferably has a Shore D hardness of 30 to 70, more preferably 35 to 65. Examples of the cover stock include ionomer resins such as Himilan (trade name, manufactured by Mitsui-duPont Polychemical K.K.) and Surlyn (trade name, manufactured by E. I. duPont), polyurethane elastomers such as Pandex (trade name, manufactured by Dai-Nihon Ink Chemical Industry K.K.), and balata rubber. Although the gage of the cover 3 is not particularly limited, it is preferably 0.5 to 3.5 mm, especially 1 to 3 mm. The cover 3 may be a single layer or a multilayer structure of two or more layers.

It is now briefly described how to prepare the golf ball of the present invention basically comprising the center ball 1, the thread rubber layer 2, and the cover 3. When thread rubber is wound around the center ball 1 to form the thread rubber layer 2 thereon to construct a wound core, thread rubber of a known type and a well-known winding method may be used. The thread rubber layer 2 preferably has a gage of 1 to 4.4 mm, especially 1.5 to 4 mm. The wound core composed of the center ball 1 and the thread rubber layer 2 is then enclosed with the cover 3 by well-known processes, for example, by directly injection molding the cover stock on the wound core. Alternatively, the cover may be applied by preforming a pair of hemispherical half cups from the cover stock, encasing the wound core in the half cups, and effecting heat pressure molding at 110° to 160° C. for 2 to 10 minutes. If desired, a cover of two or more layers may be formed by repeating the above-mentioned injection molding process or superimposing and lapping two or more pairs of preformed half cups around the wound core followed by heat pressure molding.

The wound golf ball of the invention may be formed in its cover surface with dimples in a conventional pattern by a well-known method. The ball should have a diameter of not less than 42.67 mm and a weight of not greater than 45.93 grams in accordance with the Rules of Golf.

EXAMPLE

Examples of the present invention are given below together with Comparative Examples by way of illustration and not by way of limitation.

Examples 1–6 and Comparative Examples 1–4

A center ball was prepared by milling a rubber composition of the formulation shown in Table 1 in a roll mill and pressure molding it at 155° C. for 15 minutes to form a center core. A resin as shown in Table 1 was then injection molded around the center core to form an enclosure layer on the surface of the center core, completing the center ball. Note that in Comparative Example 4, a liquid center in the form of a rubber bag filled with water was used as the center ball.

Thread rubber was wound around the center ball by a conventional winding method to produce a wound core having an outer diameter of about 39.7 mm.

A cover stock was prepared by milling 100 parts by weight of an ionomer resin, 5 parts by weight of titanium white, and 0.3 part by weight of magnesium stearate in a twin-screw extruder. All Examples and Comparative Examples used the same ionomer resin in the form of a mixture of Himilan 1601 and 1557 in a weight ratio of 50/50 (manufactured by Mitsui-duPont Polychemical K.K.). Half cups were formed from the cover stock by injection molding.

The wound core was then encased in a pair of half cups which were subject to compression molding to form a cover, obtaining a wound golf ball.

The thus produced golf balls were examined for flight and hitting feel.

The balls were actually hit with a driver (#W1) at a head speed of 50 m/sec. to measure a spin rate, carry, total distance, and angle of elevation.

The balls were also examined for hitting feel by a panel of three professional golfers who actually hit the balls. The ball was rated "◎" for very soft feel with click, "O" for soft feel with click, "Δ" for soft feel without click, and "X" for hard feel.

The results are shown in Table 2.

TABLE 1

| | | E1 | E2 | E3 | E4 | E5 | E6 | CE1 | CE2 | CE3 | CE4 |
|---|---|---|---|---|---|---|---|---|---|---|---|
| Core | Cis-1,4-polybutadiene | 100 | 100 | 100 | 100 | 100 | 100 | 100 | 100 | 100 | — |
| | Zinc acrylate | 30.0 | 27.0 | 35.0 | 30.0 | 37.0 | 45.0 | 32.5 | 18.0 | 11.5 | — |
| | Dicumyl peroxide | 1.2 | 1.2 | 1.2 | 1.2 | 1.2 | 1.2 | 1.2 | 1.2 | 1.2 | — |
| | Antioxidant | 0.2 | 0.2 | 0.2 | 0.2 | 0.2 | 0.2 | 0.2 | 0.2 | 0.2 | — |
| | Zinc oxide | 5 | 5 | 5 | 5 | 5 | 5 | 5 | 5 | 5 | — |
| | Barium sulfate | 45.3 | 46.3 | 43.7 | 33.7 | 66.1 | 294.8 | 34.0 | 39.4 | 105.3 | — |
| Enclosure Layer | Hytrel 4047 | 100 | — | — | 100 | 70 | — | — | — | — | — |
| | Hytrel 4767 | — | 100 | — | — | — | — | — | — | — | — |
| | Hytrel 8122 | — | — | 100 | — | 30 | 100 | — | — | — | — |

TABLE 2

| | | E1 | E2 | E3 | E4 | E5 | E6 | CE1 | CE2 | CE3 | CE4 |
|---|---|---|---|---|---|---|---|---|---|---|---|
| Center construction | | 2 layers | 2 layers | 2 layers | 2 layers | 2 layers | 2 layers | 1 layer | 1 layer | 1 layer | liquid |
| Core | diameter (mm) | 31.9 | 31.9 | 31.9 | 34.0 | 28.0 | 20.0 | 36.0 | 36.0 | 28.0 | 28.0 |
| | hardness* (mm) | 3.5 | 4.0 | 2.7 | 3.5 | 2.5 | 2.0 | 3.0 | 6.0 | 8.3 | — |
| Enclosure layer hardness (Shore D) | | 40 | 47 | 33 | 40 | 38 | 33 | — | — | — | — |
| Center diameter (mm) | | 35.9 | 35.9 | 35.9 | 37.0 | 35.5 | 33.0 | — | — | — | — |
| #W1 | Spin (rpm) | 2650 | 2600 | 2680 | 2700 | 2710 | 2610 | 2740 | 2510 | 2850 | 2930 |
| HS = 50 m/s | Carry (m) | 234.8 | 235.2 | 234.5 | 234.2 | 234.0 | 235.0 | 233.2 | 229.6 | 231.7 | 231.1 |
| | Total distance (m) | 247.5 | 248.1 | 247.1 | 247.2 | 247.0 | 247.7 | 246.1 | 241.3 | 243.5 | 242.8 |
| | Elevation angle (°) | 12.0 | 12.1 | 11.9 | 11.8 | 11.8 | 11.9 | 11.8 | 12.2 | 11.7 | 11.6 |
| Hitting feel | | ◎ | ◎ | ◎ | ◎ | ◎ | ◎ | X | Δ | Δ | ○ |

*Core hardness is a distortion (mm) under a load of 100 kg.

It is evident from the results in Table 2 that wound golf balls within the scope of the present invention provided satisfactory spin, flight distance and hitting feel. The hitting feel was excellent in that the golfer felt a soft impact with click. In contrast, a wound golf ball having a large diameter center of a relatively high hardness (Comparative Example 1) provided an increased spin rate, a short distance and unpleasant feel because of the hard center core. A wound golf ball having a large diameter center of a relatively low hardness (Comparative Example 2) was acknowledged to have controlled spin and improved hitting feel although it traveled only a short distance due to the lack of restitution. Its hitting feel was soft, but it lacked click. A wound golf ball having a solid center ball of a conventional diameter (not as large as the invention) (Comparative Example 3) received a high spin rate, with a resultant short distance. A wound golf ball having a conventional liquid center ball (Comparative Example 4) received an increased spin rate, with a resultant short distance. Its hitting feel was not necessarily satisfactory.

There has been described a wound golf ball which provides satisfactory spin, control and flight distance. Additionally, when the ball is hit, the hitting feel is soft and accompanied by click.

Although some preferred embodiments have been described, many modifications and variations may be made thereto in the light of the above teachings. It is therefore to be understood that within the scope of the appended claims, the invention may be practiced otherwise than as specifically described.

We claim:

1. A wound golf ball comprising: a center ball, thread rubber wound thereon, and a cover, wherein said center ball consists of a center core having an outer diameter of up to 37 mm and a distortion of 1 to 5 mm under a constant load of 100 kg and an enclosure layer enclosing the center core and having a Shore D hardness of up to 54, said center ball having an outer diameter of 33 to 38 mm, and said center core comprising a rubber composition having a base rubber, a co-crosslinking agent and a peroxide and being free of an oily substance.

2. The wound golf ball of claim 1 wherein said enclosure layer has a gage of 0.5 to 10 mm.

3. The wound golf ball of claim 1 wherein said thread rubber layer has a gage in the range of 1 to 4.4 mm.

4. The wound golf ball of claim 1 wherein said cover has a Shore D hardness of 30–70.

5. The wound golf ball of claim 1 wherein said cover has a gage in the range of 1.0 to 3.0 mm.

6. The wound golf ball of claim 1 wherein said center core has a distortion in the range of 1.8 to 4.8 mm under a constant load of 100 kg.

7. The wound golf ball of claim 1 wherein said center core has an outer diameter in the range of 20 to 36 mm.

8. The wound golf ball of claim 1 wherein said enclosure layer has a Shore D hardness in the range of 37 to 53.

9. The wound golf ball of claim 1 wherein said enclosure layer has a gage in the range of 0.5 to 7 mm.

10. The wound golf ball of claim 1 wherein said center ball has an outer diameter in the range of 34 to 37 mm.

11. The wound golf ball of claim 1 wherein said thread rubber layer has a gage in the range of 1.5 to 4.0 mm.

12. The wound golf ball of claim 1 wherein said cover has a Shore D hardness in the range of 35 to 65.

13. The wound golf ball of claim 1 wherein said cover comprises at least one layer and the total gage of said cover is in the range of 0.5 to 3.5 mm.

* * * * *